US008505833B2

(12) United States Patent
Fehr et al.

(10) Patent No.: US 8,505,833 B2
(45) Date of Patent: Aug. 13, 2013

(54) MANUAL FILLING AID WITH PUSH BUTTON FILL

(75) Inventors: Jean-Noël Fehr, Neuenburg (CH); Heiner Kaufmann, Bern (CH); Rudolf Zihlmann, Langnau (CH); Sandro Niederhäuser, Rütschelen (CH); Christopher Wiegel, Sunnyvale, CA (US); Eric Misselwitz, Stallikon (CH); Christoph Rickert, Reinach (CH)

(73) Assignees: Roche Diagnostics Operations, Inc., Indianapolis, IN (US); Roche Diagnostics International AG, Rotkreuz (CH)

( * ) Notice: Subject to any disclaimer, the term of this patent is extended or adjusted under 35 U.S.C. 154(b) by 0 days.

(21) Appl. No.: 13/429,516

(22) Filed: Mar. 26, 2012

(65) Prior Publication Data

US 2012/0186698 A1 Jul. 26, 2012

Related U.S. Application Data

(62) Division of application No. 12/244,059, filed on Oct. 2, 2008, now Pat. No. 8,141,601.

(51) Int. Cl.
*A62C 11/00* (2006.01)

(52) U.S. Cl.
USPC ..... 239/359; 239/600

(58) Field of Classification Search
USPC ..... 141/346, 347, 5, 90, 91, 193, 263; 222/153.04, 389, 394, 401; 239/302, 333, 239/337, 349, 359, 600
See application file for complete search history.

(56) References Cited

U.S. PATENT DOCUMENTS

| | | | | |
|---|---|---|---|---|
| 4,607,671 | A | 8/1986 | Aalto et al. | |
| 4,717,380 | A | 1/1988 | Baumgartner | |
| 5,217,422 | A | 6/1993 | Domzalski | |
| 5,445,631 | A | 8/1995 | Uchida | |
| 6,209,738 | B1 | 4/2001 | Jansen et al. | |
| 6,253,804 | B1 | 7/2001 | Safabash | |
| 6,453,956 | B2 | 9/2002 | Safabash | |
| 6,591,876 | B2 | 7/2003 | Safabash | |
| 6,719,719 | B2 | 4/2004 | Carmel et al. | |
| 6,786,365 | B2 | 9/2004 | Kim | |
| 7,497,358 | B2 | 3/2009 | Clynes et al. | |
| 8,141,601 | B2 * | 3/2012 | Fehr et al. | 141/346 |
| 2004/0044327 | A1 | 3/2004 | Hasegawa | |
| 2005/0033231 | A1 | 2/2005 | Powell | |

FOREIGN PATENT DOCUMENTS

| | | | |
|---|---|---|---|
| EP | 1 430 864 | A1 | 6/2004 |
| WO | WO 0029049 | A1 | 5/2000 |

* cited by examiner

*Primary Examiner* — Davis Hwu
(74) *Attorney, Agent, or Firm* — Woodard, Emhardt, Moriarty, McNett & Henry LLP

(57) ABSTRACT

A medical liquid transfer system includes a pump configured to transfer liquid between at least two containers. A detachable connector is detachably secured to the pump. The detachable connector has at least one pump passage to transmit pumping pressure from the pump to at least one of the containers. The detachable connector can include one or more liquid impermeable and gas permeable membranes to ensure the liquid is retained in the detachable connector. After the fluid is transferred the detachable connector is removed and replaced by a new one in order to prevent contamination of the pump. An interlock mechanism is used to prevent premature removal of the detachable connector and/or the container being filled.

16 Claims, 16 Drawing Sheets

MANUAL FILLING AID WITH PUSH BUTTON FILL

CROSS-REFERENCE TO RELATED APPLICATION

This application is a divisional of U.S. patent application Ser. No. 12/244,059, filed Oct. 2, 2008, now U.S. Pat. No. 8,141,601, which is hereby incorporated by reference.

BACKGROUND

The present invention generally concerns, but is not limited to, a device for transferring medication as well as other medical liquids between containers.

In the medical field, there is always a need to transfer medications or other medical related liquids, such as insulin, from one container to another. For example, doctors and nurses routinely draw medications from vials into syringes in order to inject the medications into patients. With the advent of patients taking greater charge of their medical care, there is even a more pronounced need for this process to be easy, quick, inexpensive, and most importantly safe. Although syringes are typically inexpensive, many patients with motor difficulties, such as diabetics with neuropathy or the elderly, have difficulty in safely handling syringes. Accidental needle sticks and transferring the proper amount of medication are always a concern. Cross-contamination of medications between containers is also problematic. Moreover, certain medical environments do not even require syringes for providing medication to the patient, and thus, the syringe is wasted when used to transfer medications between vials.

Thus, there is a need for improvement in this field.

SUMMARY

As will be described below, a reusable pumping mechanism has been developed to pump liquid medication between at least two containers. The pumping mechanism is able to transfer medical liquids between containers, such as ampoules, vials, etc., without the need for syringes. To reduce expense, the pumping mechanism has been designed to be re-used such that the mechanism is able to perform multiple fluid transfers. By being re-useable, the pump is able to carry sophisticated components that can more accurately control dispensing while still remaining competitive with conventional single use designs. In addition, the re-usable pump has been designed so that even those with dexterity problems can easily pump the medication.

During the development of the pump mechanism, it was discovered that the pump was prone to being contaminated by the fluid being pumped. As should be recognized, cleaning the pump after such contamination is extremely difficult and time consuming, such that, as a practical matter, any contaminated pump had to be replaced by a new one. The inventors have solved this pump contamination problem by incorporating a detachable connector that transmits the pumping pressure from the pump to at least one of the containers. After each pumping procedure, the detachable connector is discarded and replaced with a new one that is detachably secured to the pump mechanism. To further reduce the risk of pump contamination, the detachable connector incorporates a liquid impermeable filter or membrane that prevents liquid infiltration into the pump. The detachable connector in still yet another aspect includes a second liquid impermeable filter or membrane that prevents liquid from leaking out an air vent in the detachable connector.

In a further aspect, the detachable connector includes at least one fluid transfer flow path through which the liquid is transferred between the containers. The detachable connector is used to secure both containers to one another as well as to the pump mechanism. With fluid transfer flow path inside the connector, the risk of vial cross-contamination between various batches is lessened because the detachable connector is discarded after each use. In one form, one or more needles are used to pierce the septum of the containers as well as transfer fluid between the containers. To reduce the risk of the user accidentally sticking themselves with the needle, the needle tips are recessed inside the detachable connector.

As mentioned before, ensuring that a consistent and proper amount of medication is deposited into the destination container is always a concern. The pumping system also incorporates a unique interlock mechanism or arrangement that prevents the destination (originally empty) container from being removed from the pump mechanism until the proper volume of liquid has been pumped into the destination container. In one form, the destination container is secured to the pump mechanism via the detachable connector. The detachable connector has at least one catch secured to the pump mechanism at a location where it cannot be manually released until the push button used to actuate the pump is fully depressed, thereby ensuring the full amount of fluid has been pumped. To put it another way, the pump mechanism interferes with the user's ability to release the catch until the pump mechanism is fully actuated.

Still yet another aspect concerns a unique valve arrangement that holds the push button in a pressed-down state so as to facilitate easy release of the catch mechanism.

Further forms, objects, and aspects of the present invention will be appreciated from the following discussion.

DESCRIPTION OF SELECTED EMBODIMENTS

Figure 1:
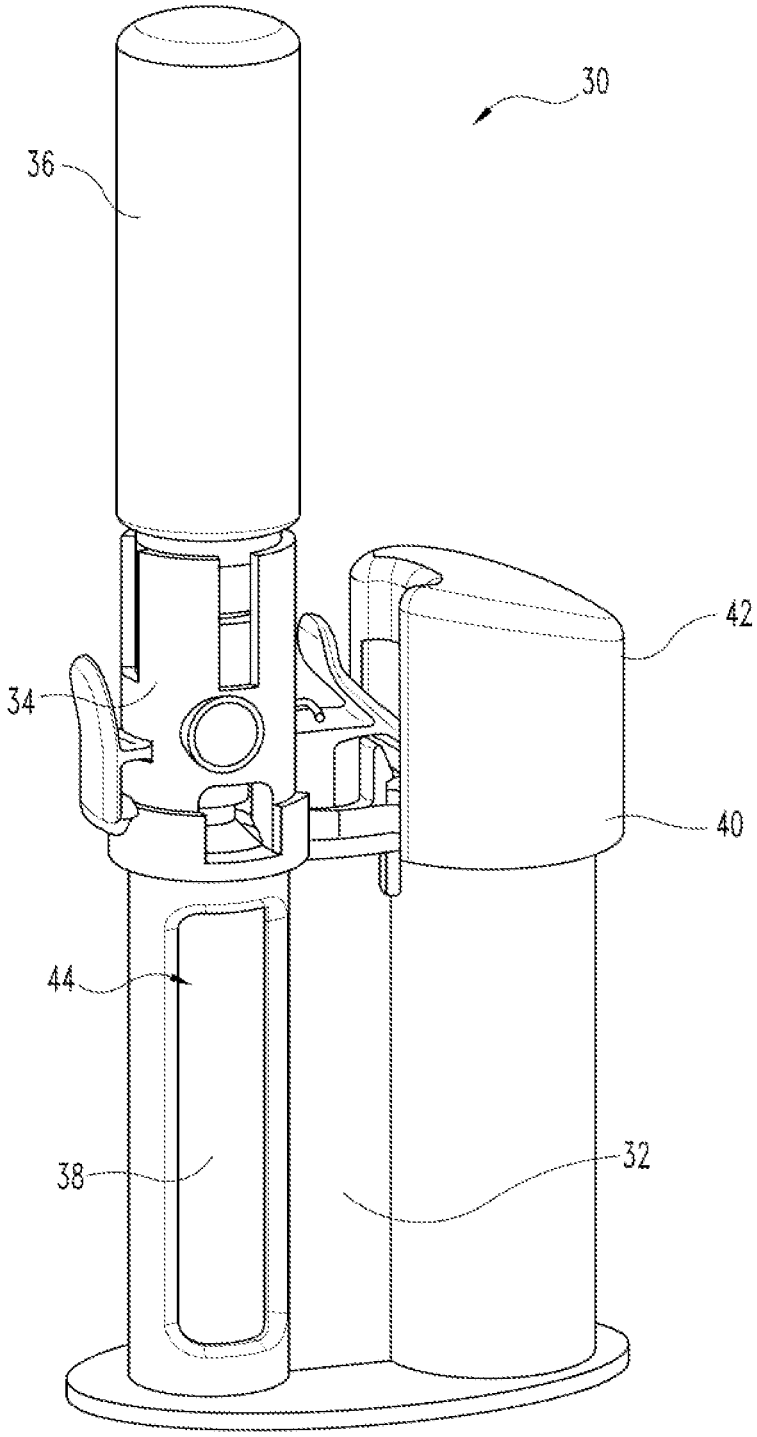
FIG. 1 is a perspective view of a fluid transfer system according to one embodiment.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the invention may not be shown for the sake of clarity. It should be noted that directional terms, such as "up", "down", "top" and "bottom", are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Figure 2:
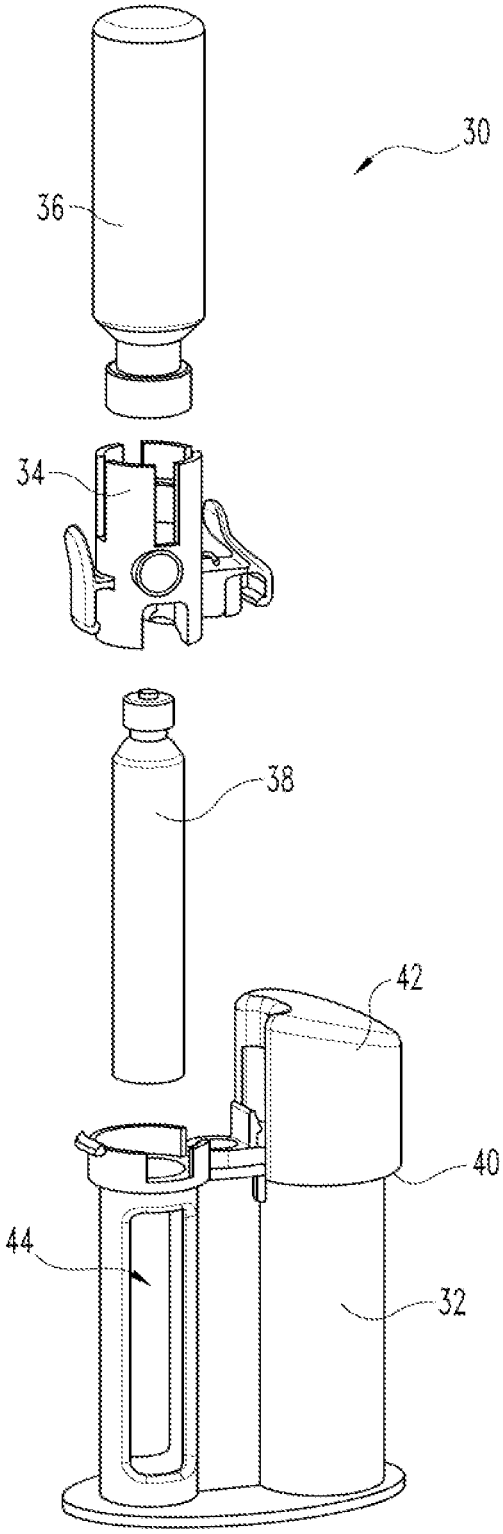
FIG. 2 is an exploded view of the FIG. 1 system.

A perspective view of a medical liquid transfer system 30 according to one embodiment is illustrated in FIG. 1, and FIG. 2 shows an exploded view of the system 30. As can be seen, the system 30 includes a pump base 32 and a disposable, detachable connector or coupler 34 that couples a supply container 36 and a destination or target container 38 to the pump base 32. In the illustrated embodiment, the containers 36, 38 are vials or ampoules, but the containers 36, 38 can include other types of containers in other embodiments. The pump base 32 includes a pump mechanism 40 with a push button 42 that is manually pressed in order to pump liquid medication from the supply container 36 to the destination container 38 via the detachable connector 34. The pump base 32 further has a compartment 44 configured to receive the destination container 38. In the illustrated embodiment, the pump mechanism 40 and the compartment 44 are generally arranged in a parallel fashion but can be arranged differently in other embodiments. As noted before, contamination of the pump base 32 as well as the container 36, 38 is problematic for a number of reasons. To prevent cross-contamination, the detachable connector 34 in the embodiment shown is able to be detached from the pump base 32 after use so that the detachable connector 34 can be discarded and replaced with a new one. In other words, the detachable connector 34 is designed as a disposable unit that can be packaged in a sterile state before use and discarded after one or more of the destination containers 38 are filled to the desired level.

Figure 3:
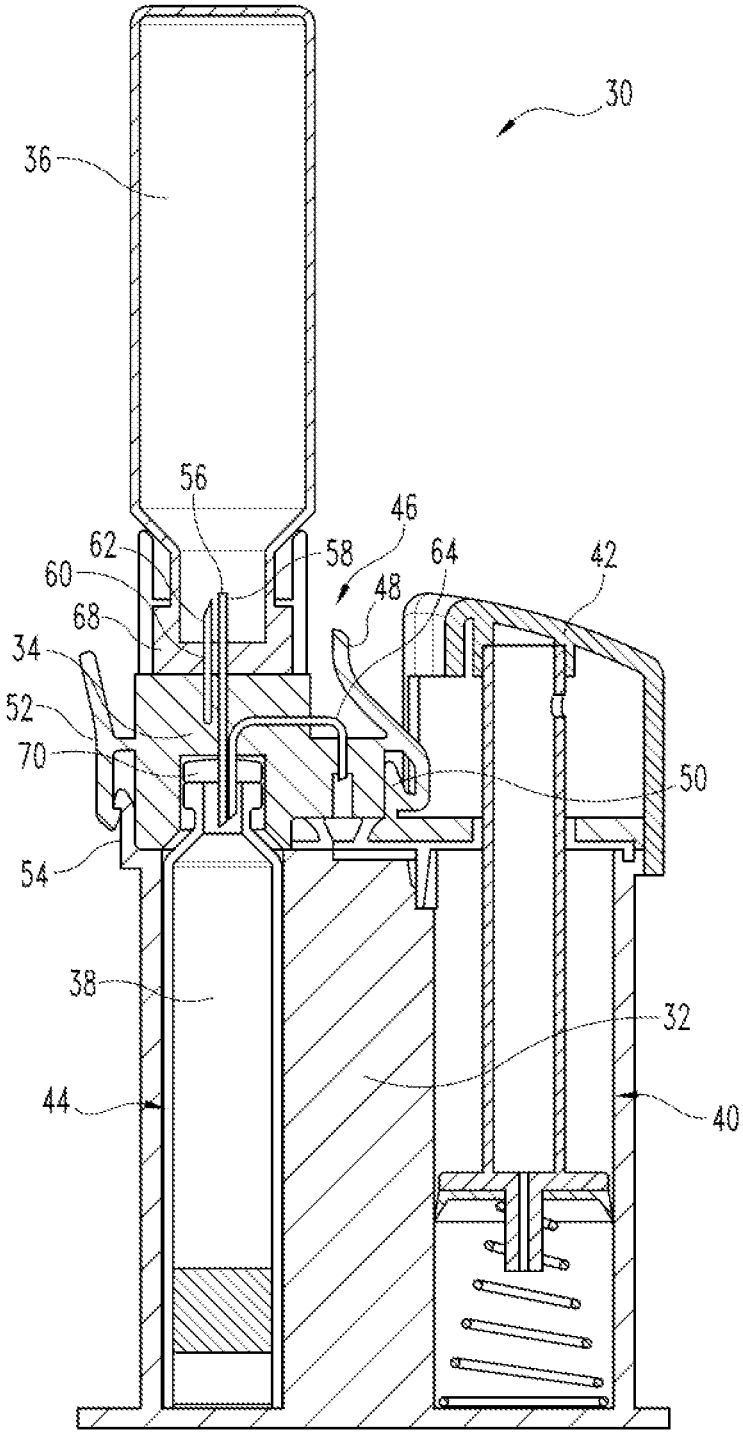
FIG. 3 is a cross-sectional view of the FIG. 1 system.

Turning to FIG. 3, which illustrates a cross-sectional view of the system 30, the pump base 32 and detachable connector 34 incorporate a unique interlock mechanism 46 that prevents anyone from readily removing the destination container 38 before the pump mechanism 40 is moved through its complete pumping stroke, thereby facilitating proper filling of the destination container 38. As can be seen, the interlock mechanism 46 includes a first catch 48 on the detachable connector 34 that clips to a first clip 50 on the pump base 32 for detachably securing the detachable connector 34 to the pump base 32. When secured, the detachable connector 34 closes the compartment 44 in the pump base 32, thereby retaining the destination container 38 in the pump base 32. In the illustrated interlock mechanism 46, the first catch 48 is positioned between the detachable connector 34 and the push button 42 when in an extended, unactuated state. At this position, the user is unable to easily remove the destination container 38 from the pump base 32 without significantly damaging the pump base 32, the connector 34, and/or the destination container 38. When the push button 42 is pressed completely down such that the pump mechanism 40 is fully actuated, the user then is able to access the first catch 48 so as to release the detachable connector 34 from the pump body 32 without appreciable damage by squeezing the first catch 48 towards the detachable connector 34.

As mentioned before, the detachable connector 34 is detachably secured to the pump base 32 as well as the containers 36, 38 so that the detachable connector 34 can be removed and discarded (or recycled) after use. By being discarded after each use, the detachable connector 34 helps to minimize the risk of cross-contamination, which in turn allows the more expensive and sophisticated components of the pump mechanism 40 to be reused. As used herein, the phrase "detachably secured" or variations thereof means that the detachable connector 34 is secured on a temporary basis to the pump base 32 and can be easily removed by hand (without the need of tools) while not appreciably damaging the pump base 32 and/or the destination container 38. The detachable connector 34 can be damaged during the removal process, and in selected embodiments, the detachable connector 34 is specifically designed to be damaged so that the detachable connector 34 cannot be reused. For example, the detachable connector 34 in other embodiments can incorporate a pull-tab type tamper evidence arrangement that is similar to those found on caps of plastic milk jugs. The end of the tab is positioned such that it can be only pulled when the push button 42 is fully depressed. Once the pull tab is removed, the detachable connector 34 is unable to be re-secured to the pump base 32. In the depicted embodiment, the detachable connector 34 has a second catch 52 that clips to a second clip 54 on the pump base 32 to further detachably secure the detachable connector 34 to the pump base 32. The system 30 in other embodiments can include more or less catches 48, 52 and clips 50, 54 than are shown and/or other structures for detachably securing the detachable connector 34 to the pump base 32. For instance, a single catch can be used along with a snap-type pin arrangement in order to detachably secure the detachable connector 34 to the pump base 32.

Referring again to FIG. 3, the detachable connector 34 has a fluid transfer conduit 56 with a fluid transfer passage 58 configured to transfer fluid from the supply container 36 to the destination container 38. The detachable connector 34 further includes a vent conduit 60 with a vent passage 62 that vents air into the supply container 36 in order to equalize pressure inside the supply container 36 as liquid is removed. A pump conduit 64 with a pump passage transmits the pressure differential (or pump pressure) created in the pump mechanism 40 to the destination container 38. The conduits 56, 60, 64 in the depicted embodiment are pointed needles or cannulas so that the conduits 56, 60, 64 are able to pierce septums 68, 70 of the containers 36, 38. It should be recognized that the conduits 56, 60, 64 can be configured differently in other embodiments so as to access other types of container enclosures. As can be seen, the containers 36, 38 are oriented in a linear fashion in which their openings face one another. This orientation allows the fluid transfer conduit 56 to be straight, which in turn facilitates smooth fluid flow. The pump conduit 64 opens at the top of the destination container 38 such that the risk of liquid being drawn into the pump conduit 64 is reduced. With the supply container 36 turned upside down, the fluid transfer conduit 56 is able to nearly empty the supply container 36.

In the illustrated embodiment, as the push button 42 is pressed down, a vacuum or an under pressure condition is created in the pump mechanism 40, and given that the pump conduit 64 in the detachable connector 34 links the pump mechanism 40 to the destination container 38, a vacuum or under pressure condition is in turn formed inside the destination container 38. The relative lower pressure in the destination container 38 causes the liquid inside the supply container 36 to be sucked through the fluid transfer conduit 56 and into the destination container 38. Pressure inside the supply container 36 is equalized with outside air via the vent conduit 60.

Figure 4:
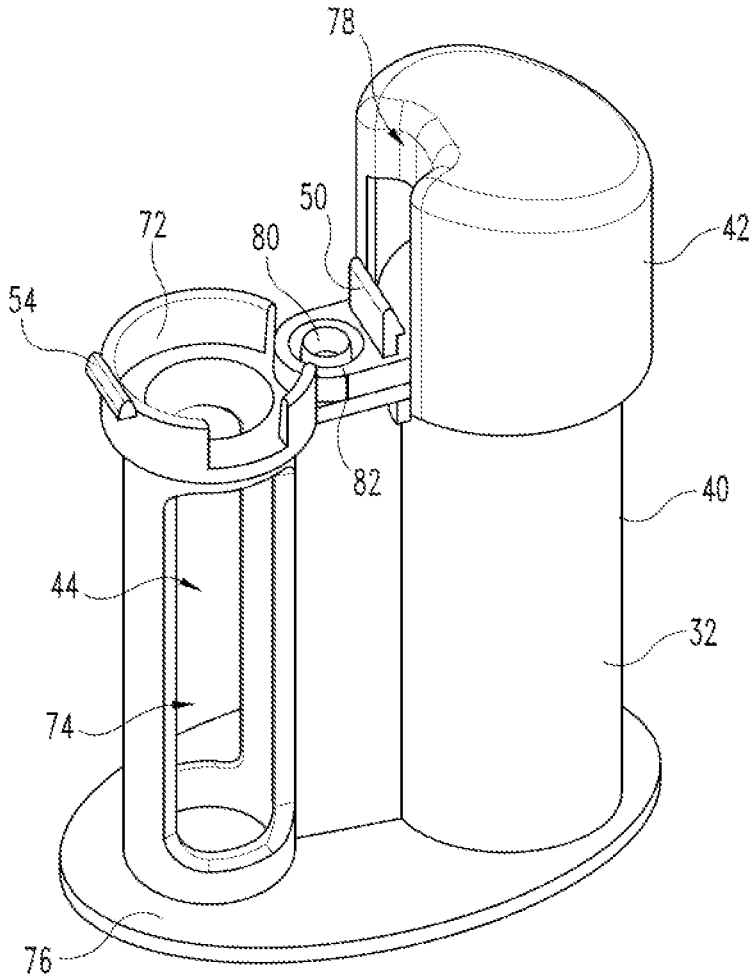
FIG. 4 is a perspective view of the pump base used in the FIG. 1 system.

FIG. 4 shows a perspective view of the pump base 32. As can be seen, the pump base 32 includes a connector receptacle 72 in which the detachable connector 34 is received, one or more window openings 74 that allow the user to see the destination container 38 being filled with liquid, and a base section 76 for stabilizing the pump base 32 on generally level surfaces. The push button 42 has an interlock slot 78 in which the first catch 48 of the interlock mechanism 46 is received so as to align the detachable connector 34 with the pump base 32 as well as further prevent premature removal of the detachable connector 34. Between the push button 42 and the connector receptacle 72, near the first clip 50, the pump base 32 has a connector port 80 that is positioned to couple with the pump conduit 64 in the detachable connector 34. Near the connector port 80, the connector receptacle 72 has a connector alignment notch 82 to assist with properly aligning the detachable connector 34 with the connector port 80. With the illustrated construction, the connector port 80 readily connects with the pump conduit 64 in the detachable connector 34 as soon as the detachable connector 34 is snapped onto the pump base 32.

Figure 5:
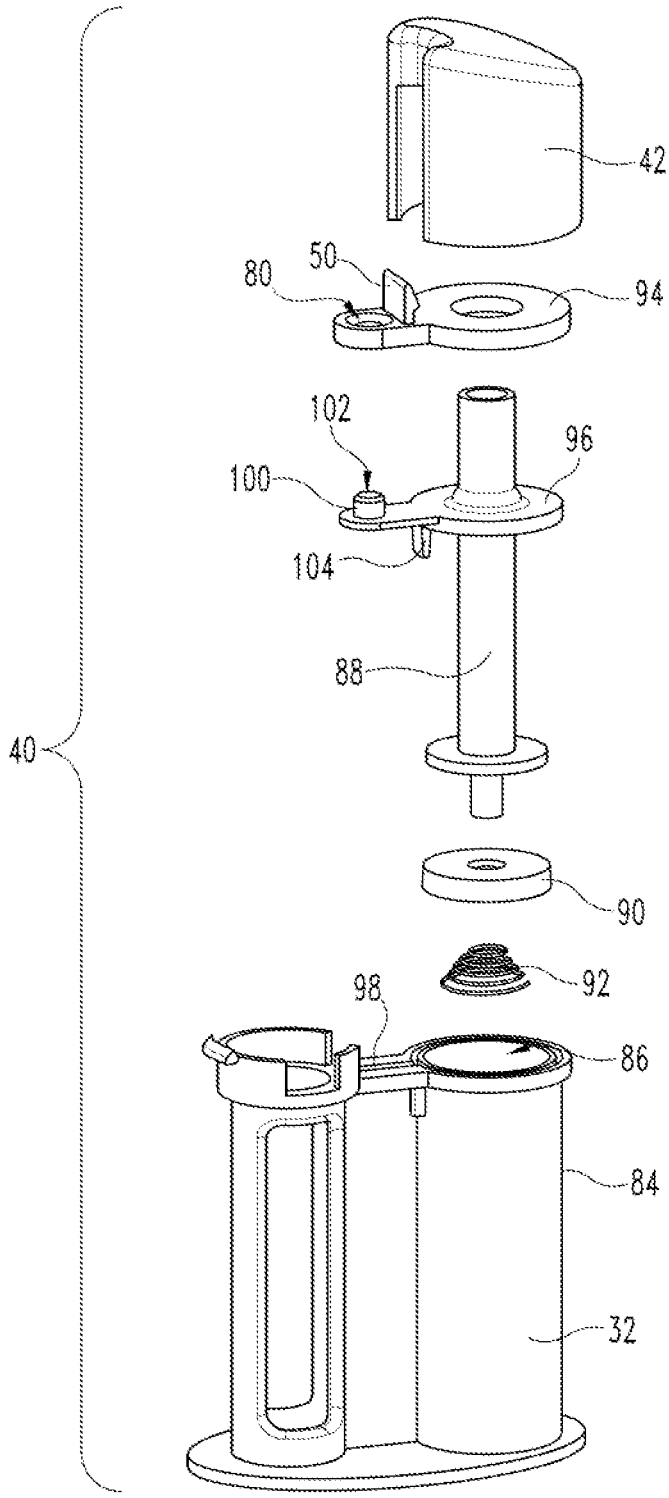
FIG. 5 is an exploded view of the FIG. 4 pump base.
Figure 6:
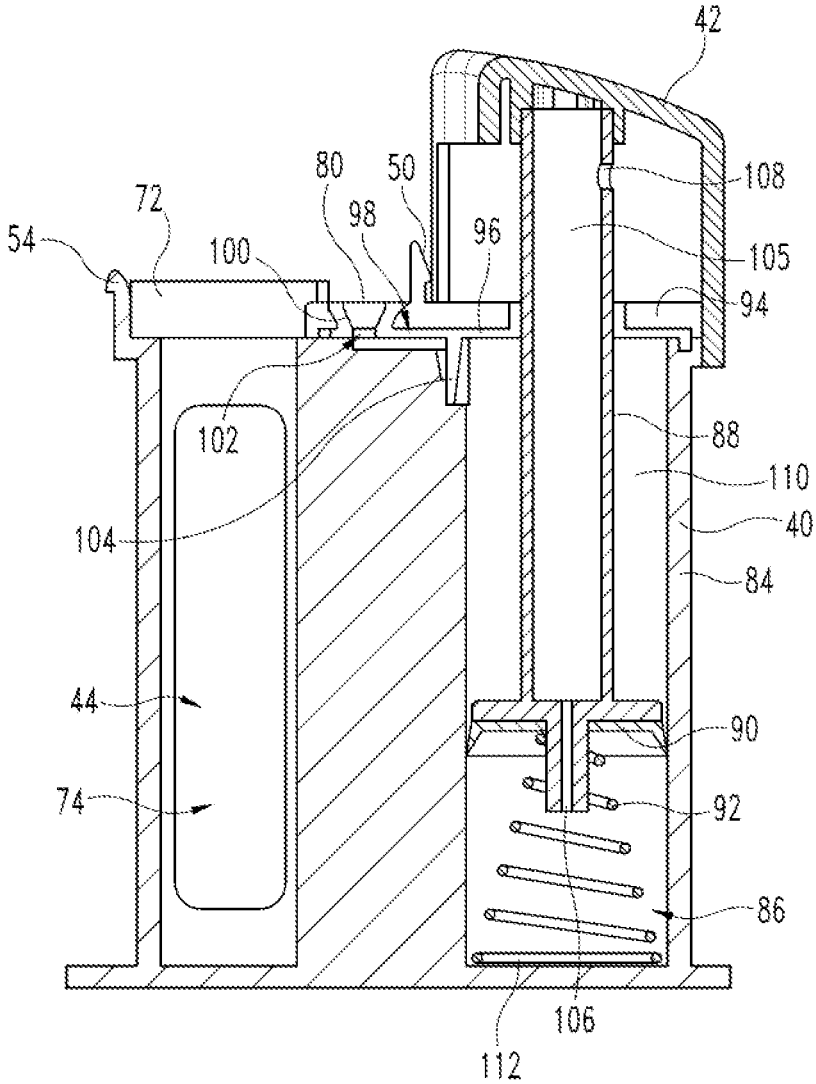
FIG. 6 is a cross-sectional view of the FIG. 4 pump base.

The pump mechanism 40 in the illustrated embodiment is a manual type pump mechanism so that the system 30 can be readily used anywhere without the need for an external power source. However, it is contemplated that other types of pumps can used, like battery powered pumps. With reference to FIGS. 5 and 6, the pump base 32 has a housing 84 that defines a pump cylinder 86. At one end, a piston rod 88 is attached to the push button 42. A piston head seal 90 along with a return spring 92 are pre-fitted on the piston rod 88 near the end opposite the push button 42. A cover 94 encloses the open end of the pump cylinder 86. As illustrated, the cover 94 defines the connector port 80 and has the first clip 50.

Between the cover 94 and the piston head seal 90, the pump mechanism 40 incorporates a unique multi-function seal 96 that is slidably received around the piston rod 88 to seal with the cover 94 and the piston rod 88. The pump base 32 has an outlet slot 98 that forms a flow path from the pump cylinder 86 to the connector port 80. At the connector port 80, the multi-function seal 96 has a connector seal 100 surrounding a connector opening 102. The connector seal 100 is configured to seal with the detachable connector 34 in order to minimize air leakage. The multi-function seal 96 further includes a one-way valve member 104 that ensures the air transfer with the pump mechanism 40 only goes one way. In the embodiment shown, the one-way valve member 104 is in the form of a flap or tab, but it should be recognized that the one-way valve member 104 can include other types of one-way valves, such as check and umbrella valves. As should be appreciated, manufacturing of the pump mechanism 40 is simplified by incorporating the connector seal 100 and the one-way valve member 104 into the unitary structure of the multi-function seal 96.

Looking at FIG. 6, the piston rod 88 defines an exhaust passage 105 with a piston head opening 106 near the piston head seal 90 and an exhaust opening 108 near the push button 42. The piston head seal 90 subdivides the pump cylinder 86 into a suction or vacuum chamber 110 and an exhaust chamber 112. When the push button 42 is pressed down, air is allowed to escape the exhaust chamber 112 via the piston head opening 106, the exhaust passage 105 and the exhaust opening 108. At the same time, a vacuum (lower pressure) is formed in the vacuum chamber 110. The lower pressure inside the vacuum chamber 110 unseats the one-valve valve member 104 such that suction is created at the connector port 80. During use, the return spring 92 biases the piston rod along with the push button 42 to the extended (unactuated) state, but the one-way action of the one-way valve member 104 tends to hold the button 42 in the depressed state.

Figure 7:
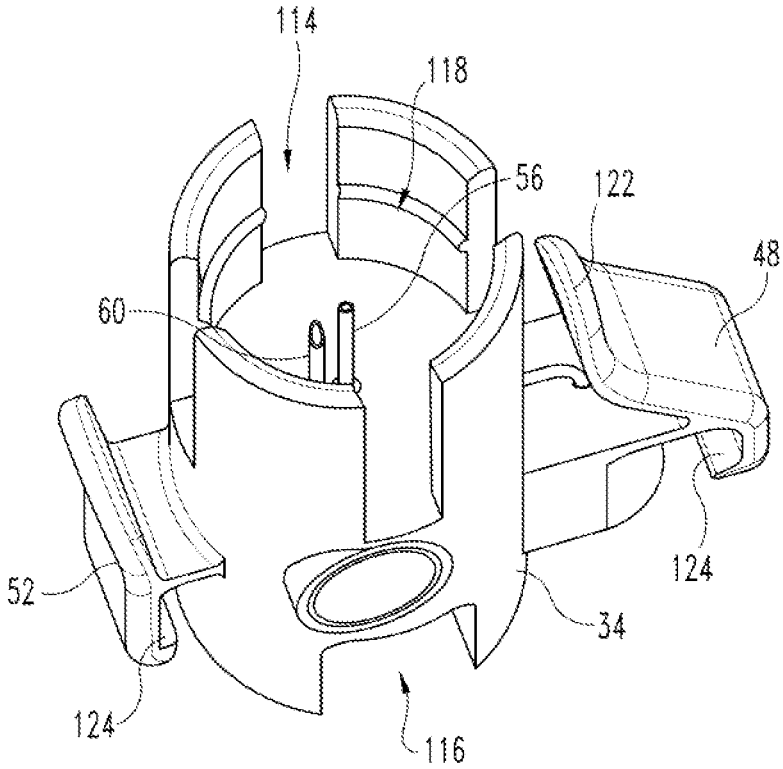
FIG. 7 is a top perspective view of a detachable connector used in the FIG. 1 system.
Figure 8:
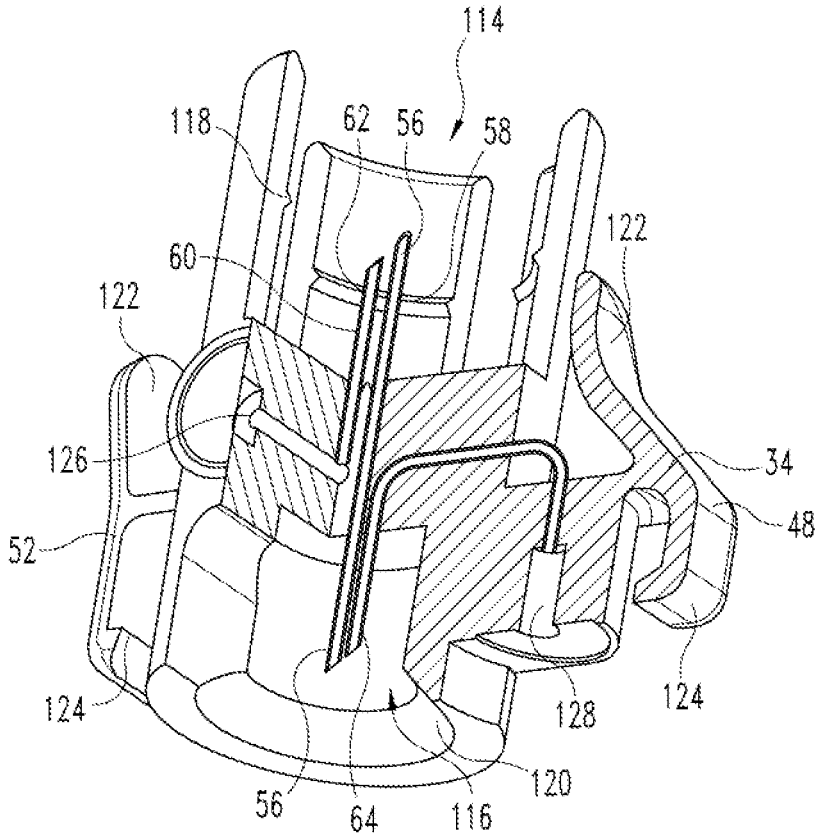
FIG. 8 is a partial cross-sectional view of the FIG. 7 detachable connector.
Figure 9:
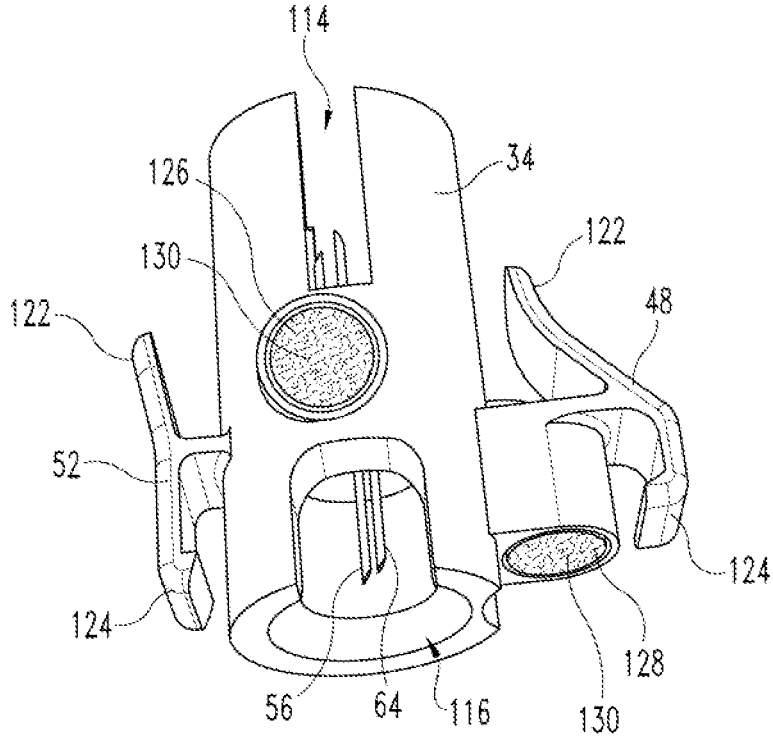
FIG. 9 is a bottom perspective view of the FIG. 7 detachable connector.

As noted before, the detachable connector 34 is configured to prevent contamination by retaining any of the residual fluid from the transfer procedure within the detachable connector 34. Afterwards, the detachable connector 34 can be disposed of and replaced by a new one, thereby preventing cross-contamination between successive filling operations as well as preventing contamination of the pump base 32. With reference to FIGS. 7, 8, and 9, the detachable connector 34 has a supply container receptacle 114 in which an end of the supply container 36 is received and a destination container receptacle 116 in which an end of the destination container 38 is received. As mentioned before, the ends of the fluid transfer 56, vent 60, and pump 64 conduits are pointed or otherwise made sharp in order to pierce the septums 68, 70 of the containers 36, 38. To reduce the risk of injury, the sharp ends of the fluid transfer 56 and vent 60 conduits are recessed inside the supply container receptacle 114. Similarly, the sharp ends of the fluid transfer 56 and pump 64 conduits are recessed inside the destination container receptacle 116, as is depicted in FIGS. 8 and 9. Inside the supply container receptacle 114, as is shown in FIGS. 7 and 8, the detachable connector 34 has one or more catches 118 that are used to detachably secure the supply container 36 in the supply container receptacle 114. As should be appreciated, the supply container 36 can be centered and secured to the detachable connector 34 in other manners, such as through a bayonet type connection and/or a threaded connection. The container receptacle 116 has a beveled guide surface 120 for centering the destination container 38 when inserted into the destination container receptacle 116. As should be recognized, the receptacles 114, 116 in the detachable connector can be shaped differently in other embodiments.

Each of the catches 48, 52 in the depicted embodiment has a lever portion 122 and a hook portion 124. The hook portions 124 are configured to engage the clips 52, 54 on the pump base 32. The lever portions 122 are configured to be manually squeezed so as to release the hook portions 124 from the clips 52, 54. Again, it should be recognized that other structures can be used to detachably secure the detachable connector 34 to the pump base 32. For instance, a threaded connection and/or bayonet connection can be used to secure the detachable connector 34 to the pump base 32 in other embodiments.

In the embodiment shown in FIG. 8, all or part of the conduits 56, 60, 64 are embedded inside the detachable connector 34. In one particular example, the conduits 56, 60, 64 are variously shaped metallic needles embedded in the detachable connector 34 that is made of injection molded plastic. It, however, should be recognized that the various passages 58, 62 can be formed in the detachable connector 34 with or without the conduits 56, 60, 64. For example, the passages 58, 62 can be formed or otherwise made integral with the detachable connector 34. As shown, the vent passage 62 opens to the outside environment at a vent opening 126 such that air is able to be drawn into the supply container 36. The pump conduit 64 opens at a pump connection opening or port 128 where the connector port 80 of the pump base 32 is able to connect with the pump connection opening 128. As can be seen, the pump connection opening 128 is positioned to face the connector port 80 such that when the detachable connector 34 is detachably secured to the pump base 32, the pump connection opening 128 seals with the connector seal 100 at the connector port 80 such that the suction from the pump mechanism 40 can be communicated to the destination container 38 via the pump conduit 64. This configuration allows a generally airtight connection to be created without the need for the user to make a separate connection.

Figure 10:
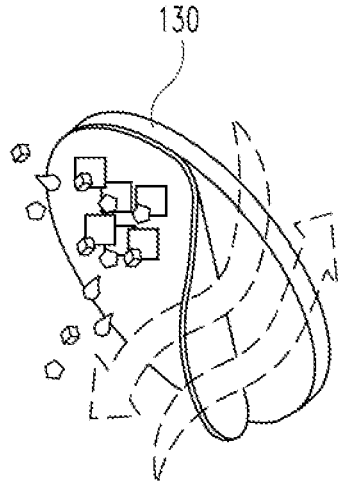
FIG. 10 is a perspective view of a liquid impermeable filter or membrane used in the FIG. 7 detachable connector.

Turning now to FIG. 9, liquid retention filters or membranes 130 are positioned at the vent 126 and pump connection 128 openings to further reduce the risk of liquid escaping or of dust entering the detachable connector 34. As is depicted in FIG. 10, the liquid retention membranes 130 are gas permeable so as to permit airflow, but at the same time are liquid impermeable to reduce the chance of liquid escaping the detachable connector. Although the membranes 130 are positioned at the vent 126 and pump connection 128 openings, the membranes 130 can be positioned elsewhere along the vent passage 62 and pump conduit 64 in other embodiments. Further, it is envisioned the detachable connector 34 in other embodiments can include fewer (even none) or more membranes 130 than illustrated.

A technique for filling the destination container 38 with a medical liquid, such as a medication, will now be described with reference to the drawings. As should be appreciated, this technique can be adapted for filling containers with numerous types of liquids, like insulin, antibiotics, diluents, etc. The destination container 38 in the illustrated embodiment is a vial with a stopper 131 (FIG. 11), but of course, this technique can be used to fully or partially fill other types of containers. For example, the destination container 38 can be initially empty and then filled with the desired volume of liquid. In another example, the destination container 38 can already be partially filled with powders, liquids, and the like before being loaded into the pump base 32, and the filling technique is used to add additional liquid to the destination container 38. Although only one destination container 38 is filled in the illustrated embodiment, it is contemplated that multiple destination containers 38 can be filled simultaneously or sequentially using this technique and system 30.

Looking at FIG. 2, the destination container 38 is loaded into the compartment 44 in the pump base 32. After the destination container 38 is loaded, the detachable connector 34 is then snapped onto the pump base 32 via the catches 48, 52 (FIG. 3). The connector receptacle 72 (FIG. 4) centers the detachable connector 34 over the destination container 38 such that, as the detachable connector 34 is pushed down towards the pump base 32, the fluid transfer 56 and pump 64 conduits are properly positioned to pierce the septum 70 of the destination container 38, and once the septum 70 is fully pierced, the conduits 56, 64 are able to establish flow paths to the inside of the destination container 38. The alignment notch 82 (FIG. 4) on the pump base 32 facilitates in aligning the pump connection opening 128 on the detachable connector 34 with the connector port 80 of the pump base 32. Once the catches 48, 52 snap onto the clips 50, 54, the connector seal 100 forms a generally airtight seal so that the suction from the pump mechanism 40 can be communicated to the destination container 38 through the pump conduit 64.

The supply container 36 is then secured to the detachable connector 34. In particular, the supply container 36 is engaged to the detachable connector 34 with the neck of the supply container 36 facing downwards. The neck of the supply container 36 is inserted into the supply container receptacle in a generally linear fashion. The supply container 36 is centered and guided by the catches 118 (FIG. 7) in the first part of the engagement movement. During engagement, the fluid transfer 56 and vent 60 conduits pierce the septum 68 of the supply container 36, thereby creating flow paths to the inside of the supply container 36. In the final part of the engagement movement, the catches 118 snap onto the neck of the supply container 36. Once the detachable connector 34 is snapped onto the pump base 32, it is difficult for the user to manually remove the destination container 38 at this point without creating significant damage. As noted before, only when the liquid has been dispensed is the user able to easily remove the detachable connector 34 to gain access to the destination container 38. Looking at FIG. 3, the push button 42 when in the extended state prevents the user from easily gripping the first catch 48.

With both septums 68, 70 pierced and the containers 36, 38 secured, the user is now able to manually pump liquid from the supply container 36 to the destination container 38. The push button 42 is pressed down, and as a result, the piston head seal 90 (FIG. 6) extends farther into the pump cylinder such that the vacuum chamber 110 expands, thereby reducing the pressure of the vacuum chamber 110. The reduced pressure inside the vacuum chamber 110 causes the one-way valve member 104 to open. With the one-way valve member 104 open, air (and/or other gases) are sucked into the pump cylinder 86 from the destination container 38 via the pump conduit 64. The resulting reduced pressure inside the destination container 38 causes the liquid to be drawn from the supply container 36 into the destination container 38 through the fluid transfer passage 58. Ambient air is drawn into the supply container 36 through the vent passage 62 in order to equalize pressure inside the supply container 36. If the destination container 38 is transparent, the liquid level inside the supply container 38 can be viewed through the windows 74.

Figure 11:
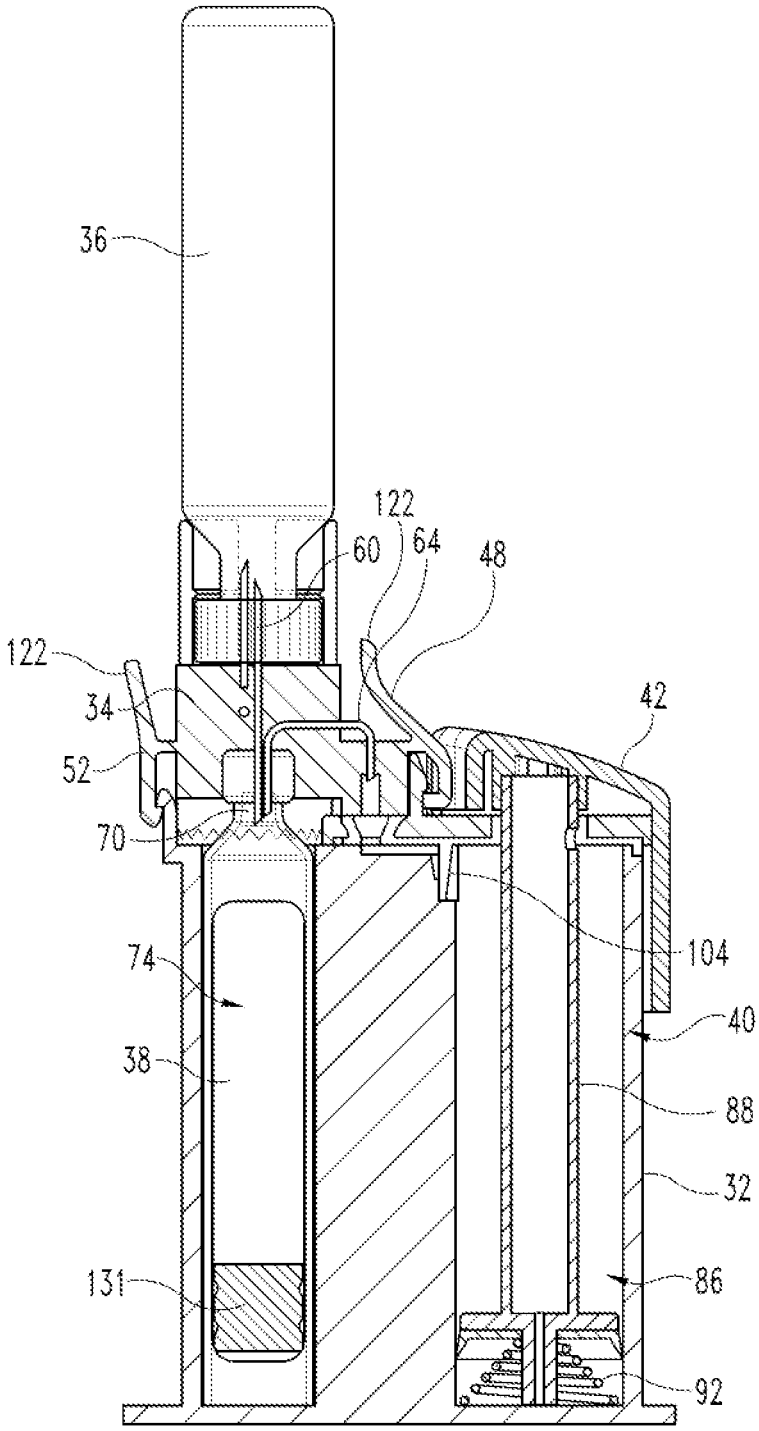
FIG. 11 is a cross-sectional view of the FIG. 1 system after the liquid has been pumped.

Once the piston rod 88 bottoms out in the pump cylinder 86, as is shown in FIG. 11, the push button 42 is unable to be pushed down any farther, thereby indicating that the proper dose of liquid was transferred into the destination container 38. This arrangement ensures that a consistent volume of liquid is transferred every time. However, in other embodiments, the pump base 32 can include an adjuster, such as a threaded adjuster, that adjusts the stroke length of the pump mechanism 40 so that the user can adjust the desired liquid volume to be transferred. Although the return spring 92 is biased to extend the piston rod 88 along with the push button 42, the one-way valve member 104 prevents this from occurring. The one-way valve member 104 prevents air from escaping the pump cylinder 86 such that the piston rod 88 remains stationary. For example, if the user releases the push button 42 mid-stroke or when fully depressed, the push button 42 will remain in the same position (at least on a temporary basis).

As soon as the destination container 38 is properly filled, the supply container 36 can then be disconnected from the detachable connector 34. With the push button 42 fully pressed down, the user is then easily able to grasp the lever portion 122 of the first catch 48. The levers 122 of the catches 48, 52 then can be squeezed towards one another, which in turn releases the detachable connector 34 from the pump base 32. As the detachable connector 34 is pulled from the pump base 32, the tips of the fluid transfer 56 and the pump 64 conduits are at the same time removed from the septum 70 of the supply container 38. The detachable connector 34, which is contaminated with liquid, can then be discarded, recycled, and/or cleaned. In other variations, the supply container 36 can remain attached to the detachable connector 34 so that both the supply container 36 and the detachable connector 34 can be discarded as a single unit. Considering the pump base 32 remains clean of liquid during the procedure, the pump base 32 can be reused by simply using a new (or clean) detachable connector 34. After the detachable connector 34 is removed, the destination container 38 can then be removed from the pump base 32. During removal, the user can grasp the neck of the destination container 38 to pull the destination container 38 from the pump base 32 and/or the destination container 38 can be lifted by grasping the sides of the destination container 38 through the window openings 74.

In the above-described technique, the push button 42 is pressed in order to exchange the liquid between the containers 36, 38. However, in other embodiments, the liquid can be transferred as the return spring 92 resets the push button 42 to the original extended position. In the previously described technique, the liquid was transferred as a result of the pump mechanism 40 generating suction, but in other embodiments, the liquid transfer can occur as a result of the pump mechanism 40 generating high pressure. In still yet another variation, a two-part pump system can at the same time create high pressure in the supply container 36 and low pressure in the destination container 38 to improve pumping efficiency. Instead of exhausting air from the exhaust chamber 112 through the exhaust opening 108 (FIG. 6), the higher pressure air from the exhaust chamber 112 is piped to the supply container 36 and at the same time the pump mechanism 40 reduces the pressure in the destination container 38 in the same fashion described above. With such a two-part pump design, both chambers 110, 112 of the pump cylinder 86 typically will have volumes larger than that of the supply container 36 in order to allow for complete evacuation of the supply container 36 in a single stroke, if needed.

Figure 12:
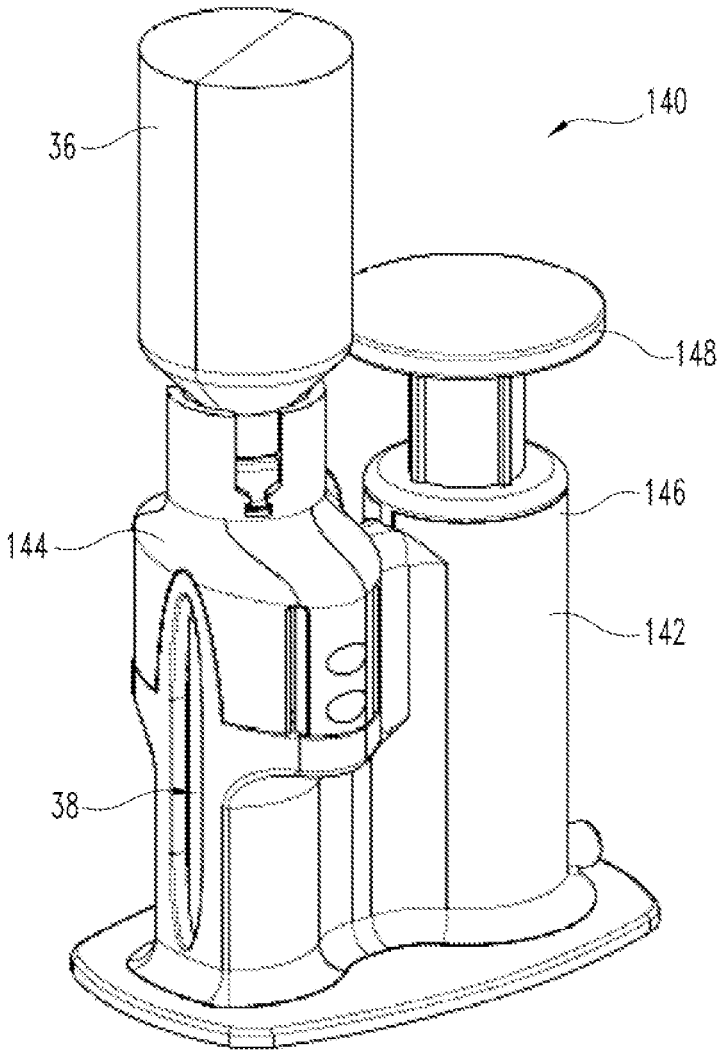
FIG. 12 is a perspective view of a fluid transfer system according to another embodiment.
Figure 13:
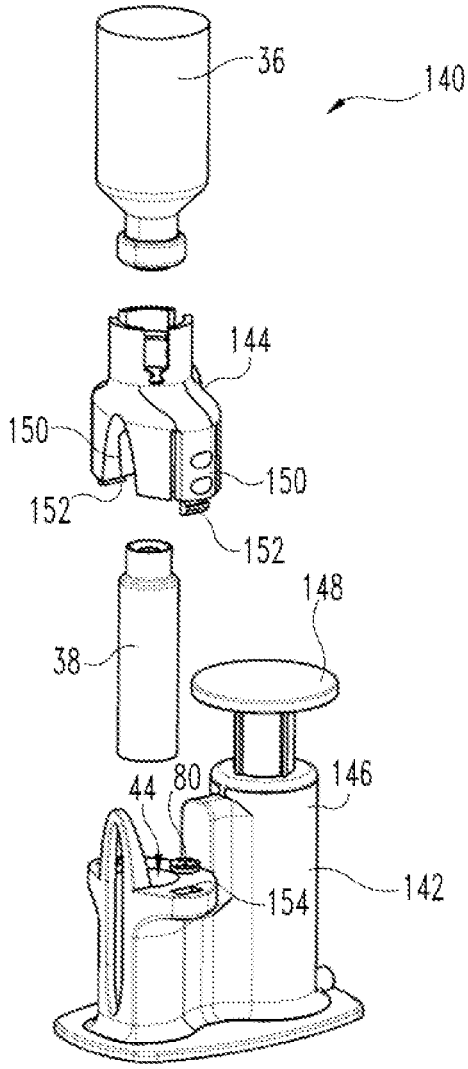
FIG. 13 is an exploded view of the FIG. 12 system.

A perspective view of a medical liquid transport system 140 according to another embodiment is illustrated in FIG. 12. In comparison to the FIG. 1 system 30 in which the fluid was transferred when the push button 42 is pressed down, the fluid in the FIG. 12 system 140 is transferred during the return stroke of the button. As will be explained below, this design creates a constant backpressure, which in turn reduces the formation of bubbles in the pumped fluid. FIG. 13 shows an exploded view of the system 140. As can be seen, the system 140 in FIG. 12 shares a number of features in common with the previously described one. For the sake of brevity and clarity, these common components will not be again described in great detail, but reference is made to the previous descriptions of these features. Looking at FIGS. 12 and 13, the system 140 includes a pump base 142 and a disposable, detachable connector or coupler 144 that couples the supply container 36 and the destination or target container 38 to the pump base 142. The pump base 142 includes a pump mechanism 146 with a push button 148 that is manually pressed and released in order to pump liquid medication from the supply container 36 to the destination container 38 via the detachable connector 144. The pump base 142 further has the compartment 44 configured to receive the destination container 38. In the illustrated embodiment, the pump mechanism 146 and the compartment 44 are generally arranged in a parallel fashion but can be arranged differently in other embodiments. To prevent cross-contamination, the detachable connector 144 in the embodiment shown is able to be detached from the pump base 142 after use so that the detachable connector 144 can be discarded and replaced with a new one. In particular, the detachable connector 144 has a pair of opposing catches 150 with clips 152 that engage with catch openings 154 in the pump base 142.

Figure 14:
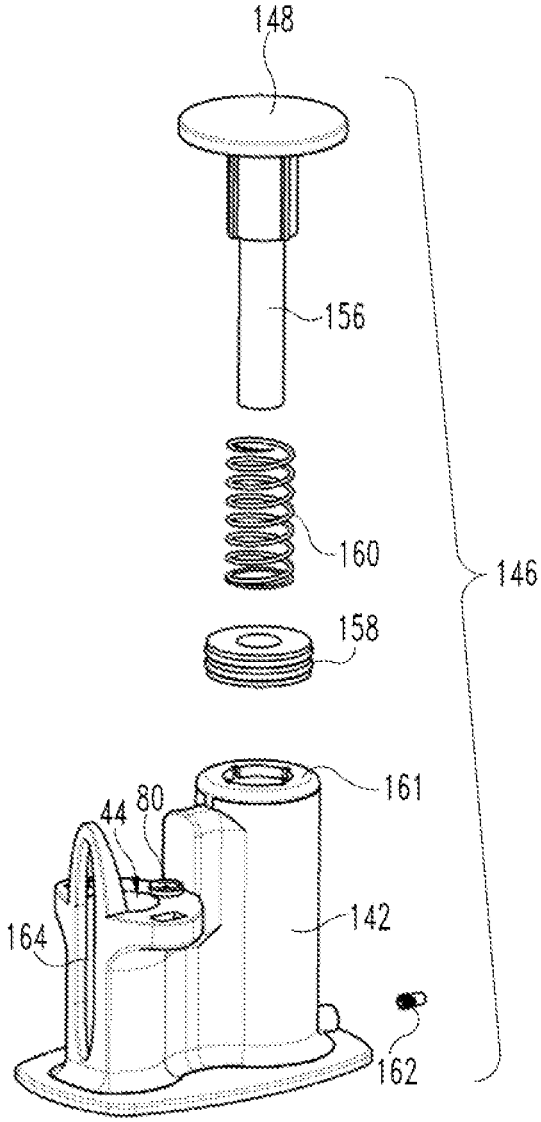
FIG. 14 is an exploded view of a pump base used in the FIG. 12 system.

FIG. 14 shows an exploded view of the pump base 142 and the pump mechanism 146. As shown, the pump mechanism 146 includes a piston rod 156 that is connected to the button 148, a piston 158 that connects to the piston rod 156, and a return spring 160 for biasing the button 148. A retaining collar 161 retains the piston 158 within the pump base 142. The pump mechanism 146 further includes a one-way valve 162. In the illustrated embodiment, the one-way valve 162 is a check valve, but other types of one way valves, such as umbrella valves, can be used. The pump base 142 also has a window opening 164 that allows the user to see how far the destination container 38 has been filled.

Figure 15:
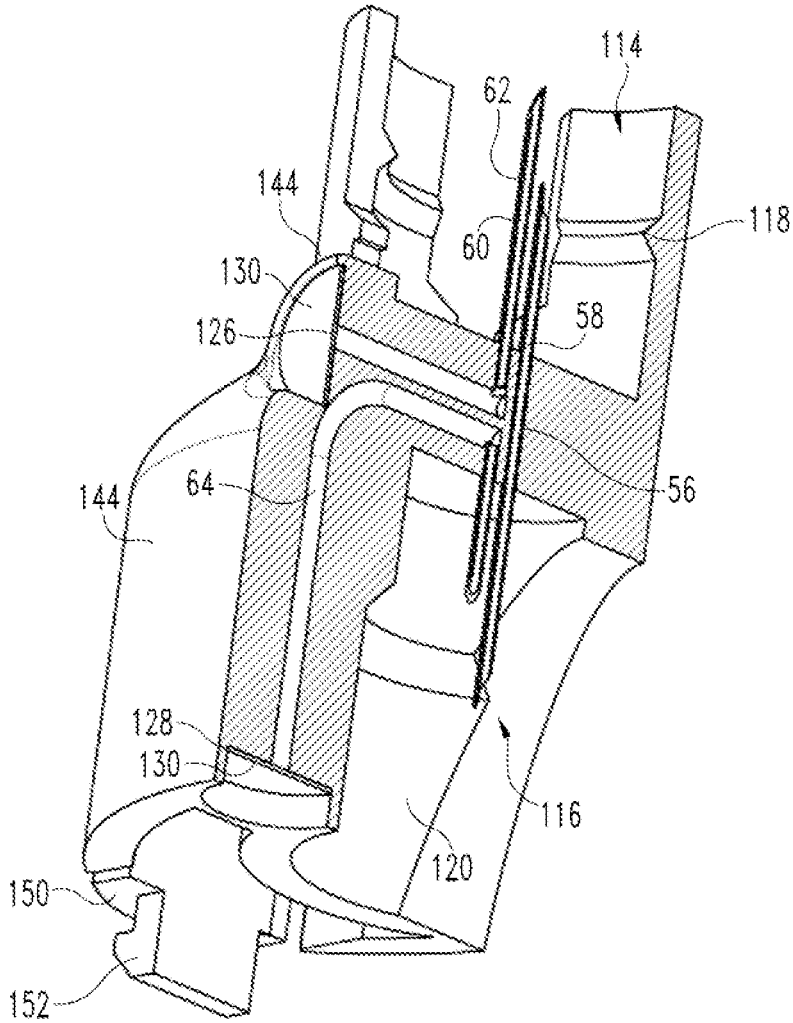
FIG. 15 is a partial cross-sectional view of a detachable connector used in the FIG. 12 system.

The detachable connector 144 in the FIG. 12 embodiment shares a number of features in common with the detachable connector 34 in the FIG. 1 embodiment, which will not be again discussed at great length. Like the previously described embodiment, the detachable connector 144 is configured to prevent contamination by retaining any of the residual fluid from the transfer procedure within the detachable connector 144. FIG. 15 shows a partial cross-sectional view of the detachable connector 144. As can be seen, the detachable connector 34 has the supply container receptacle 114 with one or more catches 118 to which the end of the supply container 36 is secured and the destination container receptacle 116 with the beveled guide surface 120 in which the end of the destination container 38 is received. Like before, the ends of the fluid transfer 56, vent 60, and pump 64 conduits are pointed or otherwise made sharp in order to pierce the septums 68, 70 of the containers 36, 38. As shown, the vent passage 62 opens to the outside environment at the vent opening 126 and the pump conduit 64 opens at the pump connection opening or port 128 where the connector port 80 of the pump base 32 is able to connect with the pump connection opening 128. The vent 126 and pump connection 128 openings each have the liquid retention membranes 130 of the type described above so as to retain the liquid within the detachable connector 144 and to prevent dust from entering the detachable connector 144. The pump connection opening 128 is positioned to face the connector port 80 such that when the detachable connector 144 is detachably secured to the pump base 32, the pump connection opening 128 seals with the connector port 80.

Figure 16:
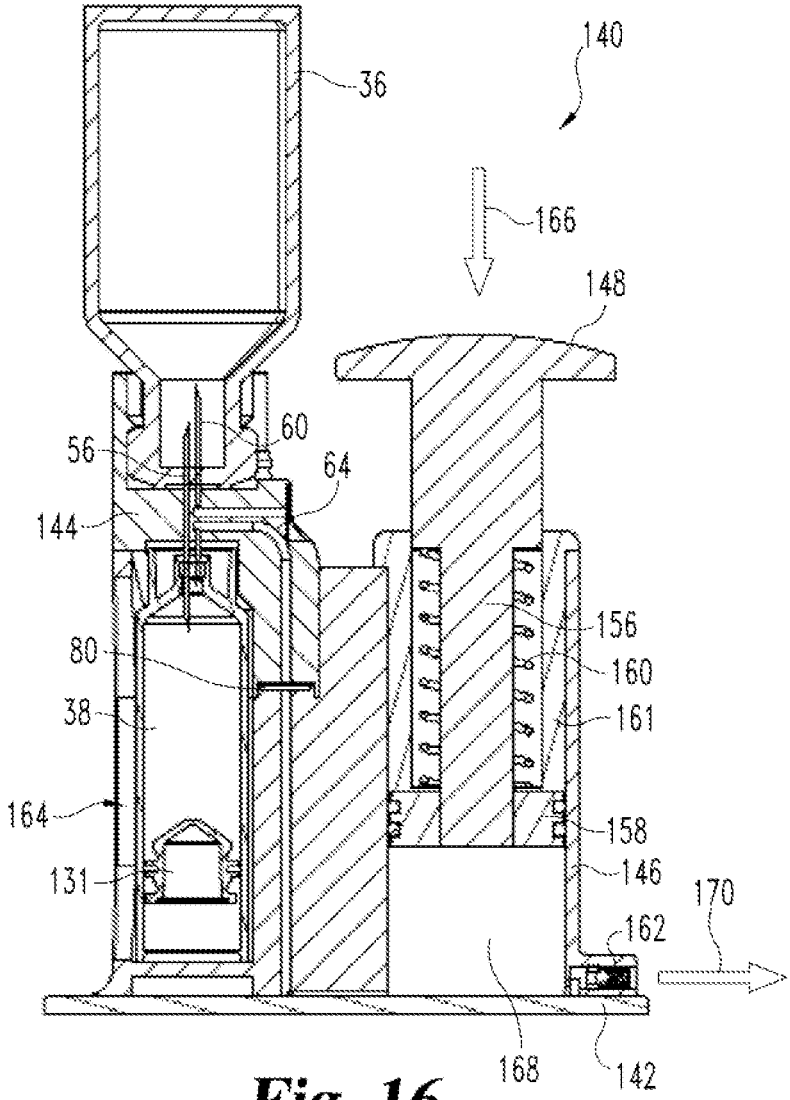
FIG. 16 is a cross-sectional view of the FIG. 12 system during the down-stroke of the pump.
Figure 17:
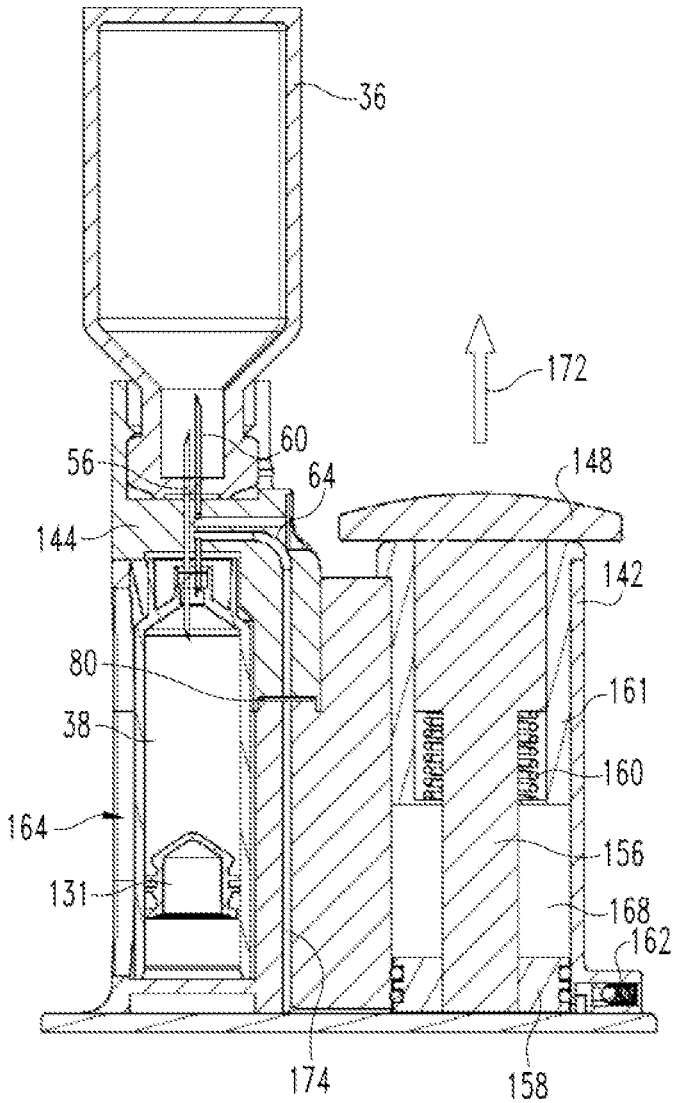
FIG. 17 is a cross-sectional view of the FIG. 12 system during the up-stroke of the pump.

A cross-sectional view of the system 140 during operation is depicted in FIG. 16. To initiate the fluid transfer process, the user pushes down the button 148, as is indicated by arrow 166. As the piston 158 slides downward, air within pump chamber 168 is exhausted through the one-way valve 162, as is shown with arrow 170. Looking at FIG. 17, the spring 160 becomes compressed between the button 148 and the collar 161. When the button 148 is released, the spring 160 causes the button 148 to move upwardly (arrow 172) to its original position, which in turn creates a vacuum in the pump chamber 158. Instead of the user creating the back pressure for pumping the fluid, the spring 160 creates the back pressure, which in turn leads to a more constant and consistent back pressure. The constant back pressure created by the spring 160 reduces bubble formation in the pumped fluid. The pump base 142 has a pump channel 174 that transmits the vacuum or suction from the pump chamber 168 to the pump conduit 64 in the detachable connector 144 via the connector port 80. Consequently, the pressure inside the destination container 38 is reduced, and fluid from the supply container 36 is transferred to the destination container 38 through the fluid transfer conduit 56. The pressure inside the supply container is equalized by drawing outside air via the vent conduit 60.

It is contemplated that other embodiments can include some of the features described above while excluding other features. For example, certain features of the above-described embodiments can be incorporated into systems in which the connector is not detachable, but rather, the entire pump mechanism is disposable. In another example, it is contemplated that the supply and destination containers do not have to be aligned, but instead, the containers can be angled with respect to one another in order to enhance ergonomics. Some of the above-described systems have been designed to achieve complete evacuation and/or filling of the containers through a single stroke. However, in other embodiments, complete evacuation and/or filling can be achieved by multiple pumping strokes.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

What is claimed is:

1. An apparatus, comprising:

a pump to pump liquid;

a container secured to the pump;

an interlock mechanism configured to release the container from the pump after the pump has pumped the liquid;

a detachable connector detachably secured to the pump to enclose the container in the pump;

the interlock mechanism being configured to prevent removal of the detachable connector after the pump has pumped the liquid;

the pump including a container compartment;

the container being received in the container compartment;

the detachable connector including a catch clipped to the pump to enclose the container compartment;

the interlock mechanism including a push button configured to manually actuate the pump; and the push button being moveable between an extended state and a depressed state to pump the liquid, in which the push button in the extended state blocks manual release of the catch, and in which the push button in the depressed state allows manual release of the catch.

2. The apparatus of claim 1, in which the pump includes a one-way valve configured to hold the push button in position at least at the depressed state.

3. The apparatus of claim 1, further comprising:

the detachable connector including a membrane to minimize contamination of the pump by the liquid, the membrane being liquid impermeable and gas permeable.

4. The apparatus of claim 3, wherein the detachable connector has at least one pump passage to transmit pumping pressure from the pump to the container.

5. The apparatus of claim 4, in which the membrane is positioned to filter the liquid from the pump passage.

6. The apparatus of claim 4, further comprising:

the detachable connector including a vent passage configured to vent ambient air; and the membrane being disposed along the vent passage.

7. The apparatus of claim 1, further comprising:

the pump including a connector port;

the detachable connector having at least one pump passage to transmit pumping pressure from the pump to the container;

wherein the pump passage has a pump connection opening where the pump passage connects to the connector port of the pump; and wherein the pump includes a connector seal surrounding the connector port to seal the pump connection opening with the connector port.

8. The apparatus of claim 7, wherein:

the connector seal is incorporated into a multi-function seal; and the multi-function seal includes a one-way valve member that ensure airflow with the pump only goes one way.

9. The apparatus of claim 8, wherein the one-way valve is configured to hold the push button in position at least at the depressed state.

10. An apparatus, comprising:

a pump to pump liquid, the pump including a container compartment in which a container is received;

a detachable connector including a catch clipped to the pump, wherein the detachable connector encloses the container in the container compartment when the catch is clipped to the pump; and a push button being moveable between an extended state and a depressed state to pump the liquid, in which the push button in the extended state blocks the catch, and in which the push button in the depressed state allows release of the catch.

11. The apparatus of claim 10, in which the pump includes a one-way valve configured to hold the push button in position at least at the depressed state.

12. The apparatus of claim 10, wherein the detachable connector has at least one pump passage to transmit pumping pressure from the pump to the container.

13. The apparatus of claim 12, further comprising:

the pump including a connector port;

wherein the pump passage has a pump connection opening where the pump passage connects to the connector port of the pump; and wherein the pump includes a connector seal surrounding the connector port to seal the pump connection opening with the connector port.

14. The apparatus of claim 13, wherein:

the connector seal is incorporated into a multi-function seal; and the multi-function seal includes a one-way valve member configured to hold the push button in position at least at the depressed state.

15. The apparatus of claim 12, further comprising:

a membrane positioned to filter the liquid from the pump passage, the membrane being liquid impermeable and gas permeable.

16. The apparatus of claim 12, further comprising:

the detachable connector including a vent passage configured to vent ambient air; and a membrane disposed along the vent passage, the membrane being liquid impermeable and gas permeable.

* * * * *